United States Patent [19]

Seki et al.

[11] 3,963,449

[45] June 15, 1976

[54] SINTERED METALLIC COMPOSITE MATERIAL

[75] Inventors: Shigeru Seki; Taketoshi Kato; Toshikuni Itou; Hiroo Sasaki, all of Nagoya, Japan

[73] Assignee: Ishizuka Garasu Kabushiki Kaisha, Japan

[22] Filed: Apr. 29, 1974

[21] Appl. No.: 464,931

[30] Foreign Application Priority Data

May 4, 1973 Japan ..... 48-50001

[52] U.S. Cl. ..... 29/182.5; 75/206

[51] Int. Cl.[2] ..... B22F 3/00; B22F 1/04; C22C 33/02

[58] Field of Search ..... 29/182.3, 182.5; 75/206, 212

[56] References Cited

UNITED STATES PATENTS

| | | | |
|---|---|---|---|
| 3,139,671 | 7/1964 | Herron et al. | 29/182.3 |
| 3,386,814 | 6/1968 | Alexander et al. | 75/212 |
| 3,725,091 | 4/1973 | Chyung et al. | 29/182.3 |

*Primary Examiner*—Benjamin R. Padgett
*Assistant Examiner*—Josephine Lloyd
*Attorney, Agent, or Firm*—Sherman & Shalloway

[57] ABSTRACT

A sintered metallic composite material which comprises a. sintered particles of a substrate metal, and b. at least about 1 percent by weight, based on the weight of the composite material, of particles of a glass-ceramic having a metallic coating layer being integrally bonded to the glass-ceramic body, wherein said particles of glass-ceramic (b) are uniformly dispersed in the composite material and firmly retained therein through said metallic coating layer bonded to said substrate metal (a) in the sintered state.

10 Claims, No Drawings

SINTERED METALLIC COMPOSITE MATERIAL

This invention relates to an improved sintered metallic composite material, and more specifically to a sintered metallic composite material comprising a body of sintered metal powders and particles of glass-ceramics uniformed dispersed and firmly retained therein.

Various sintered metallic composite materials have previously been produced by powder metallurgical techniques, and have found applications as machine parts such as brakes of vehicles, bearings or heat resistant filters, electrical component parts such as electrical contacts or collector brushes, and materials for producing special alloys such as hard alloys or heat-resistant alloys. Since these conventional sintered materials and methods for their production are well known, it does not appear necessary to describe them in detail. It will suffice only to cite a typical example of producing such sintered materials, which comprises uniformly mixing particles of lead, graphite, silica, alumina, etc. as an additive with a substrate metallic component resulting from various combinations of powdery copper, iron,, aluminum, silver and alloys of these metals, molding the mixture under pressure, and then heating the molded product in vacuo or in atmosphere, of hydrogen, decomposed ammonia gas (25 % $N_2$ and 75 % $H_2$) or a modified hydrocarbon gas. The lead and graphite used as the additive are soft and slippery materials, and their presence impart lubricity and smooth operability to the sintered product. On the other hand, silica and alumina are hard materials which give abrasion resistance and friction resistance to the sintered product. In order to have these desirable characteristics exhibited fully, it is necessary that the silica or alumina particles should not be easily removed off from the surface of the sintered product. Actually, however, when the sintered product undergoes friction under a heavy load, the silica or alumina itself tends to break or drop off. Attempts have also been made to use a hard material such as silicon carbide, a silica-alumina complex or spinel instead of the silica and alumina. However, since the bond between the particles of these materials and the substrate metallic component is not sufficiently firm, the dropping off of these particles cannot be prevented when the sintered product undergoes friction under a heavy load. In the circumstances, sintered products having fully satisfactory properties for use under high speed-high load conditions, for example, for use in brakes of airplanes or brakes of railway vehicles which have tended to be driven at higher speeds in recent years, have not yet been obtained.

It is an object of this invention to provide a sintered metallic composite material comprising a sintered body and glass-ceramic particles dispersed and firmly retained therein so as to avoid dropping off, and a process for producing the sintered metallic composite material. The sintered product of this invention can be used for the various uses described above, and are especially advantageously used in usages which require friction characteristics and abrasion resistance.

The sintered metallic composite material of this invention comprises a. sintered particles of a substrate metal, and
b. at least about 1 percent by weight, based on the weight of the composite material, of particles of glass-ceramics having a metallic coating layer of copper and/or silver, said metallic coating layer being integrally bonded to the glass-ceramic body, wherein said particles of glass-ceramics (b) are uniformly dispersed in the composite material and firmly retained therein through said metallic coating layer bonded to said substrate metal (a) in the sintered state.

The above sintered metallic composite material can be produced by uniformly mixing particles of a substrate metal with at least about 1 percent by weight, based on the weight of the composite material, of particles of glass-ceramics having a metallic coating layer of copper and/or silver, said metallic coating layer being integrally bonded to the glass-ceramic body, molding the mixture under pressure, and then heating the molded product to sinter it. The pressure for molding and the heating temperature for sintering vary according to the type of the starting materials, but the conditions employed for producing conventional sintered metallic composite materials by the powder metallurgical techniques can be applied without any particular modification.

The sintered metallic composite material of this invention is not a material obtained merely by replacing hard particles such as silica, alumina or zirconia in the conventional sintered product by glass-ceramics. The glass-ceramics in the sintered composite material of this invention have a metallic coating layer bonded integrally thereto, and are firmly bonded in the sintered state to the substrate metal component through the metallic coating layer. Accordingly, even when the sintered composite product is subjected to friction under a heavy load, the glass-ceramics do not drop off from the composite material. Thus, the product in accordance with the present invention exhibits especially superior performance in uses which require friction characteristics and abrasion resistance, for example, when used in brakes, bearings, brushes, etc.

The amount of the glass-ceramics having a metallic coating layer in the sintered metallic composite material of this invention is not particularly restricted, but is chosen over a wide range according to the use and application of the composite material. The amount can be from about 1 to 100 % by weight, based on the weight of the composite material. Accordingly, even when the particles of the metal coated glass-ceramics alone are molded under pressure, and sintered, there can be obtained a composite materiaL of good quality, and such a composite material is suitable for application to a heat-resistant filter. However, it has been found that when it is desired to obtain composite materials to be used under frictional conditions, the amount of the glass-ceramics is preferably about 2 to 65 % by weight, based on the weight of the composite material. For example, when the substrate metal component in the composite material consists mainly of copper or iron, the preferred amount of the glass-ceramics is about 2 to 50 %, and when it consists mainly of aluminum, the preferred amount is about 2 to 65 % by weight.

The size of the glass-ceramics particles is also not particularly restricted. However, it has been found that when it is desired to obtain composite materials to be used under frictional conditions, the suitable particle size is 1 to 400 microns. When the particle size is less than 1 micron, there is a tendency that composite materials of sufficient strength cannot be obtained, and on the other hand, if it exceeds 400 microns, the glass-ceramics tend to drop off to some extent, and are likely to injure the metallic material with which they come into contact. The particles of the glass-ceramics can be in the form of beads of regular shape, pulverized particles of irregular shape, or pulverized fibers. If desired, other powdery substances such as silica or alumina normally used in the conventional products can be incorporated into the composite material of this invention in addition to the glass-ceramics.

A preferred embodiment of producing particles of glass-ceramics having a metallic coating layer will be described below.

Generally, the glass-ceramics or devitrified glass having a metallic coating layer of copper and/or silver can be produced by the conventional methods (for example, those disclosed in U.S. Pat. Nos. 3,464,806 and 3,790,360, German Pat. No. 1,496,540, DAS 2,209,373, and British Pat. Nos. 944,571 and 1,341,533 and French Pat. No. 1,383,611). The glass-ceramics having a metallic layer are generally made by melting a glass-ceramic-forming batch containing a nucleating agent and a small amount of copper and/or silver compound, forming the melt into a shape of the desired configuration, and heating it under controlled conditions in a reducing atmosphere to devitrify the glass, while causing the metallic ions generated from the above metal compound to migrate through the glass matrix and diffuse to the surface of the devitrified glass body and to reduce the metallic ions to the metallic state on the surface. In this process, an intermediate layer consisting of the metal and oxides thereof which are finely dispersed in the glass matrix is formed below the metallic layer formed on the surface and continuing from it. The reason for this is that the reducing capacity of the reducing atmosphere gradually weakens as it becomes more remote from the surface. Thus, since the metallic layer is integrally bonded to the glass-ceramic body through the intermediary of the intermediate layer, its adhesiveness is exceedingly strong. This adhesiveness is far greater than that of a metallic layer which is formed on the surface of a glass body from its outside as in the case of vacuum evaporation, electroless plating and other means of depositing metallic layers. The glass composition for making glass-ceramics is not particularly restricted, but some typical examples of the glass compositions include silica-alumina-lithia, silica-alumina-lithia-magnesia, silica-alumina-zinc oxide, silica-alumina-magnesia, silica-alumina-calcium oxide and silica-lithia systems.

When it is desired to produce great quantities of the metal coated glass-ceramics in the form of mutually separated particles, care must be taken so as to prevent the particles from being bonded to each other in the sintered state through the metallic layer formed on the surface, during the manufacturing process. In order to ensure this, it is preferred to mix the particles obtained by mixing the melt of the starting glass-ceramics-forming batch uniformly with the particles of a heat-resistant mineral material, and then heat-treating this mixture in a reducing atmosphere, as described above. By so doing, the glass-ceramic particles do not contact each other during the manufacturing process by the presence of the particles of the heat-resistant mineral material, and therefore, are not sintered in the mutually adhered state. After the heat-treatment and cooling, the metal coated glass-ceramic particles can be separated from the particles of the heat-resistant mineral material by suitable means such as decantation, water sieving, floatation, or vibrating gravity concentration.

Examples of the heat-resistant mineral material are alumina, silica, magnesia, zirconium, zirconia, beryllia, silicon carbide, mullite, or porcelains. Preferably, the particle size of the heat-resistant material is almost the same as that of the glass-ceramic particles, and the amount of the heat-resistant material used is at least about 40 % based on the volume of the glass-ceramic particles.

The following Examples further illustrate the present invention and its advantages.

In these Examples, typical sintered metallic composite materials which have been conventionally used as materials to be subjected to frictional conditions, such as for use in vehicle brakes and bearings, are shown as controls. Specifically, a material consisting mainly of copper, a material consisting mainly of iron, and a material consisting mainly of aluminum are shown Also, as products of this invention, there are shown examples of composite materials in which various amounts of glass-ceramic particles are dispersed, and firmly retained, in these control materials.

As the particles of glass-ceramics having a metallic coating, fibers having a size of about 20 microns (80 to 350 Tyler mesh) prepared by the method described above from a glass composition consisting, by weight, of 60.5 % $SiO_2$, 21.8 % $Al_2O_3$, 3.6 % $Li_2O$, 2.7 % $ZrO_2$, 4.6 % F, 0.8 % $B_2O_3$ and 6.0 % CuO were used.

A test piece of each composite material was subjected to a friction test, and the coefficient of kinetic friction, the amount of friction and the maximum temperature which was reached during the test were measured.

EXAMPLE 1

A particle mixture according to each of the formulations (weight basis) described in Table I was molded at a molding pressure of 5 tons/cm, and the molded sample was heated for 1 hour at 770°C. and 5 Kg/cm² in an atmosphere of decomposed ammonia gas to sinter it. Samples Nos. 1 and 2 were controls. Sample No. 1 a typical conventional composite material consisting mainly of copper, and sample No. 2 was a conventional material consisting of copper and silica. Samples Nos. 3 to 8 were composite materials in accordance with the present invention. These samples were prepared by dispersing the metal coated glass-ceramic particles in the amounts shown in Table I in the samples Nos. 1 and 2 and sintering them.

Each of the samples was subjected to a friction test under the following conditions, and the measured values obtained are shown in Table II.

Peripheral speed: 50 m/sec.
Load: 25 Kg/cm²
Disc to be contacted: Ni-Cr-Mo cast iron
Friction conducted continuously for 5 minutes.

Table I

| Sample No. | Formulation Cu (−100mesh) | Pb (−100mesh) | Sn (−100mesh) | C (−150mesh) | Silica (80–350 mesh) | Metal coated glass-ceramics (80–350 mesh) |
|---|---|---|---|---|---|---|
| 1* | 73 | 14 | 7 | 6 | — | — |
| 2* | 73 | 14 | 7 | 6 | 5 | — |
| 3 | 73 | 14 | 7 | 6 | — | 5 |
| 4 | 73 | 14 | 7 | 6 | 5 | 5 |
| 5 | 73 | 14 | 7 | 6 | — | 15 |
| 6 | 73 | 14 | 7 | 6 | 5 | 15 |
| 7 | 73 | 14 | 7 | 6 | — | 50 |
| 8 | 73 | 14 | 7 | 6 | 5 | 50 |

*Control

Table II

| Sample No. | Coefficient of kinetic friction | Amount of friction ($\times 10^{-7}$cm³/kg-m) | Maximum temperature reached (°C) | State |
|---|---|---|---|---|
| 1* | 0.51 | 32.5 | 650 | Melt-bonding remarkable, and the coefficient of friction very unstable |
| 2* | 0.42 | 16.3 | 583 | Somewhat melt-bonded, and the coefficient of friction unstable |
| 3 | 0.42 | 2.1 | 355 | No melt-bonding, and the coefficient of friction stable |
| 4 | 0.40 | 2.0 | 351 | " |
| 5 | 0.42 | 1.9 | 343 | " |
| 6 | 0.41 | 1.8 | 340 | " |
| 7 | 0.43 | 2.0 | 329 | " |
| 8 | 0.44 | 2.1 | 325 | " |

*Control

EXAMPLE 2

A particle mixture according to each of the formulations (weight basis) described in Table III was molded at a molding pressure of 5 tons/cm², and the molded sample was heated for 90 minutes at 1000°C. and 7 Kg/cm² in an atmosphere of hydrogen to sinter it. Samples Nos. 9 and 10 were controls. Sample No. 9 was a typical conventional composite material consisting mainly of iron, and sample No. 10 was a conventional composite material consisting of iron and alumina. Samples Nos. 11 to 16 were composite materials in accordance with the present invention which were prepared by dispersing the metal coated glass-ceramic particles in the amounts shown in Table IV in the samples Nos. 9 and 10, and then sintering them.

Each of the samples was subjected to a friction test under the following conditions, and the measured values obtained are shown in Table IV.

Peripheral speed: 50 m/sec.

Load: 25 Kg/cm²

Disc to be contacted: Ni-Cr-Mo cast iron

Friction conducted continuously for 5 minutes.

Table III

| Sample No. | Formulation Fe (−100mesh) | Cu (−100mesh) | Pb (−100mesh) | C (−80mesh) | Silica (80–350 mesh) | Metal coated glass-ceramics (80–350 mesh) |
|---|---|---|---|---|---|---|
| 9* | 75 | 12 | 6 | 7 | — | — |
| 10* | 75 | 12 | 6 | 7 | 15 | — |
| 11 | 75 | 12 | 6 | 7 | — | 5 |
| 12 | 75 | 12 | 6 | 7 | 15 | 5 |
| 13 | 75 | 12 | 6 | 7 | — | 10 |
| 14 | 75 | 12 | 6 | 7 | 15 | 10 |
| 15 | 75 | 12 | 6 | 7 | — | 30 |

Table III-continued

| Sample No. | Formulation Fe (−100mesh) | Cu (−100mesh) | Pb (−100mesh) | C (−80mesh) | Silica (80–350 mesh) | Metal coated glass-ceramics (80–350 mesh) |
|---|---|---|---|---|---|---|
| 16 | 75 | 12 | 6 | 7 | 15 | 30 |

*Control

Table IV

| Sample No. | Coefficient of friction | Amount of friction ($\times 10^{-7}$cm/kg-m) | Maximum temperature reached (°C) | State |
|---|---|---|---|---|
| 9* | 0.33 | 18.5 | 598 | Coefficient of friction unstable |
| 10* | 0.37 | 6.8 | 490 | " |
| 11 | 0.40 | 2.0 | 373 | Coefficient of friction stable |
| 12 | 0.43 | 1.9 | 362 | " |
| 13 | 0.42 | 1.8 | 360 | " |
| 14 | 0.40 | 1.7 | 344 | " |
| 15 | 0.41 | 1.9 | 352 | " |
| 16 | 0.45 | 1.9 | 359 | " |

*Control atmosphere of hydrogen to sinter it. Samples Nos. 17 and 18 were controls, which were typical conventional composite materials consisting mainly of aluminum. Samples Nos. 19 to 26 were composite materials in accordance with the present invention which were prepared by dispersing the metal coated glass-ceramic particles in the amounts indicated in Table V in the samples Nos. 17 and 18 and sintering them.

Each of the samples was subjected to a friction test under the following conditions, and the measured values obtained are shown in Table VI.

Peripheral speed: 30 m/sec.

Load: 5 Kg/cm$^2$

Disc to be contacted: Ni-Cr-Mo cast iron

Friction conducted continuously for 10 minutes.

Table V

| Sample No. | Formulation Al (−100mesh) | Cu (−100mesh) | Si (−325mesh) | Pb (−100mesh) | C (−150 mesh) | Metal coated glass-ceramics (80–350 mesh) |
|---|---|---|---|---|---|---|
| 17* | 85 | 3 | 10 | 2 | — | — |
| 18* | 85 | 3 | 10 | — | 2 | — |
| 19 | 85 | 3 | 10 | 2 | — | 5 |
| 20 | 85 | 3 | 10 | — | 2 | 5 |
| 21 | 85 | 3 | 10 | 2 | — | 10 |
| 22 | 85 | 3 | 10 | — | 2 | 10 |
| 23 | 85 | 3 | 10 | 2 | — | 30 |
| 24 | 85 | 3 | 10 | — | 2 | 30 |
| 25 | 85 | 3 | 10 | 2 | — | 60 |
| 26 | 85 | 3 | 10 | 2 | — | 120 |

*Control

Table VI

| Sample No. | Coefficient of friction | Amount of friction ($\times 10^{-7}$cm/Kg-m) | Maximum temperature reached (°C) | State |
|---|---|---|---|---|
| 17* | 0.37 | 6.6 | 188 | Coefficient of friction unstable |
| 18* | 0.31 | 6.3 | 180 | " |
| 19 | 0.36 | 5.0 | 179 | Coefficient of friction stable |
| 20 | 0.30 | 4.7 | 181 | " |
| 21 | 0.35 | 2.1 | 177 | " |
| 22 | 0.29 | 1.9 | 172 | " |
| 23 | 0.34 | 1.2 | 146 | " |
| 24 | 0.29 | 1.1 | 143 | " |
| 25 | 0.33 | 1.0 | 150 | " |
| 26 | 0.34 | 1.3 | 165 | " |

*Control

EXAMPLE 3

A particle mixture of each of the formulations (weight basis) shown in Table V was molded at a molding pressure of 5 tons/cm$^2$, and the molded sample was heated for 60 minutes at 620°C. and 3 Kg/cm$^2$ in an As is seen from the results obtained in Examples 1 to 3, the metal composite sintered materials in accordance with the present invention have stable coefficients of friction, and even when the friction conditions vary, the fluctuation of the coefficient of friction remains within the range of ± 5 %. The composite materials of this invention suffer from a smaller amount of friction than the corresponding controls, and the temperature rise as a result of friction is also lower. Furthermore, it is seen that the glass-ceramic particles do not at all drop off from the composite materials of this invention.

What we claim is:

1. A sintered metallic composite material which comprises a mixture of a. sintered particles of a substrate metal selected from the group consisting of copper, iron, aluminum, silver and alloys of these metals, and b. at least about 1 percent by weight, based on the weight of the composite material, of particles of a glass-ceramic having metallic ions dispersed therein, some of said metallic ions having been caused to migrate through said glass-ceramic and diffuse towards and to the surface in a reducing atmosphere thereby forming the elemental metal corresponding to said metallic ions at the surface of said particles as an integral part thereof, said metallic ions being selected from copper, silver and mixtures thereof, wherein said particles of glass-ceramic (b) are uniformly dispersed in the composite material and firmly retained therein through bonds between the substrate metal (a) and said elemental metal.

2. The sintered metallic composite material of claim 1 wherein said particles of glass-ceramic have a particle size of 1 to 400 microns, and their amount is about 2 to about 65% by weight based on the weight of the composite material.

3. The sintered metallic composite of claim 1 wherein said metal substrate (a) is copper or copper alloy and said glass ceramic particles have a particle size of 1 to 400 microns and are contained in an amount of about 2 to about 50% by weight, based on the weight of the composite material.

4. The sintered metallic composite of claim 1 wherein said metal substrate (a) is iron or iron alloy and said glass-ceramic particles have a particle size of 1 to 400 microns and are contained in an amount of about 2 to about 50% by weight, based on the weight of the composite material.

5. The sintered metallic composite of claim 1 wherein said metal substrate (a) is aluminum or aluminum alloy, and said glass ceramic particles have a particle size of 1 to 400 microns and are contained in an amount of about 2 to about 65% by weight, based on the weight of the composite material.

6. The sintered metallic composite material of claim 1 wherein said glass-ceramic is selected from the group consisting of silica-alumina-lithia, silica-alumina-lithia-magnesia, silica-alumina-zinc oxide, silica-alumina-magnesia, silica-alumina calcium oxide and silica-lithia.

7. The sintered metallic composite material of claim 3 wherein said glass-ceramic is selected from the group consisting of silica-alumina-lithia, silica-alumina-lithia-magnesia, silica-alumina-zinc oxide, silica-alumina-magnesia, silica alumina-calcium oxide and silica-lithia.

8. The sintered metallic composite material of claim 4 wherein said glass-ceramic is selected from the group consisting of silica-alumina-lithia, silica-alumina-lithia-magnesia, silica-alumina-zinc oxide, silica-alumina-magnesia, silica alumina-calcium oxide and silica-lithia.

9. The sintered metallic composite material of claim 5 wherein said glass-ceramic is selected from the group consisting of silica-alumina-lithia, silica-alumina-lithia-magnesia, silica-alumina-zinc oxide, silica-alumina-magnesia, silica alumina-calcium oxide and silica-lithia.

10. A process for producing a sintered metallic composite material, which comprises uniformly mixing (a) particles of a substrate metal selected from copper, iron, aluminum, silver, and alloys of these metals with (b) at least about 1 percent by weight, based on the weight of the composite material, of particles of a glass-ceramic having metallic ions dispersed therein, some of said metallic ions having been caused to migrate through said glass-ceramic and diffuse towards and to the surface in a reducing atmosphere thereby forming the elemental metal corresponding to said metallic ions at the surface of said particles as an integral part thereof, said metallic ions being selected from copper, silver and mixtures thereof; molding the mixture; and heating the mixture to sinter it whereby the glass-ceramic particles are uniformly dispersed in the composite material and firmly retained therein through bonds between the substrate metal (a) and the elemental metal.

* * * * *